US009599422B2

(12) United States Patent
Mundy

(10) Patent No.: US 9,599,422 B2
(45) Date of Patent: Mar. 21, 2017

(54) AUTOMATIC SIMULATION RECOILER FOR CONVERTING A FIREARM INTO A SIMULATOR

(71) Applicant: Clinton Gregory Mundy, Martinez, GA (US)

(72) Inventor: Clinton Gregory Mundy, Martinez, GA (US)

( * ) Notice: Subject to any disclaimer, the term of this patent is extended or adjusted under 35 U.S.C. 154(b) by 267 days.

(21) Appl. No.: 14/337,526

(22) Filed: Jul. 22, 2014

(65) Prior Publication Data

US 2016/0025442 A1 Jan. 28, 2016

(51) Int. Cl.
*F41A 33/06* (2006.01)

(52) U.S. Cl.
CPC ..... *F41A 33/06* (2013.01)

(58) Field of Classification Search
CPC ..... F41A 33/00; F41A 33/02; F41A 33/04; F41A 33/06; F41G 3/26; F41G 3/2622; F41G 3/2627; F41G 3/2611; F41G 3/2633; F41G 3/2661; F41B 11/00
See application file for complete search history.

(56) References Cited

U.S. PATENT DOCUMENTS

| | | | | |
|---|---|---|---|---|
| 4,480,999 | A | 11/1984 | Witherell et al. | |
| 6,682,350 | B2 | 1/2004 | Kehl et al. | |
| 7,033,175 | B2 | 4/2006 | Kunimoto | |
| 8,602,784 | B2 | 12/2013 | Dvorak | |
| 8,608,474 | B2 | 12/2013 | Markert et al. | |
| 2012/0129136 | A1* | 5/2012 | Dvorak | F41A 33/02 434/18 |
| 2014/0272806 | A1* | 9/2014 | Hunt | F41A 33/00 434/16 |

* cited by examiner

*Primary Examiner* — Timothy A Musselman
(74) *Attorney, Agent, or Firm* — Jeffrey C. Watson; Grell & Watson Patent Attorneys

(57) ABSTRACT

An automatic recoiler for converting a firearm into a simulator includes a sealed cylinder with a piston. A piston rod extends from the piston through the rebound chamber and out of the cylinder. A gas block at the end of the rebound chamber has a pressure relieve valve for allowing fluid to enter and exit. The cylinder includes an inlet port in communication with the compression chamber. The piston rod has an end face sized to contact a front surface of the slide for recoiling the slide backward. A power source moves the piston thereby extending the piston rod from the cylinder. A controller controls the power source thereby controlling the extension of the piston rod from the cylinder. Whereby, when a user presses the trigger, the controller controls the power source to move the piston thereby extending the piston rod from the cylinder and recoiling the slide backward.

16 Claims, 5 Drawing Sheets

AUTOMATIC SIMULATION RECOILER FOR CONVERTING A FIREARM INTO A SIMULATOR

CROSS-REFERENCE TO RELATED APPLICATIONS

None

FEDERALLY SPONSORED RESEARCH OR DEVELOPMENT

None

PARTIES TO A JOINT RESEARCH AGREEMENT

None

REFERENCE TO A SEQUENCE LISTING

None

BACKGROUND OF THE INVENTION

Technical Field

The disclosure generally relates to firearms and guns and simulators thereof. In particular, the instant disclosure relates to a automatic simulation recoiler for converting an automatic or semi-automatic firearm into a simulator.

Description of Related Art

The instant disclosure relates to firearms and, more particularly, to providing a means for simulating firearm recoil in automatic and semiautomatic firearms or guns. Because of the lethal characteristics inherent in operating guns, proper training in their use may be extremely important. Such training most often involves the firing of blanks or live ammunition. Loud noise, spent cartridge waste, noxious burned powder fumes, repetitive reloading, environmental constraints, unnecessary costs, and overall danger are all significant deterrents to the use of blanks or live ammunition.

Various attempts have been made to develop a realistic weapon simulator or to retrofit a working pistol into a simulator with limited success. The shortcomings of known simulators is that they are either built as non/firing gas operated replicas or they are converted real pistols where the conversion of the pistol to a simulator is difficult to implement, i.e., the conversion often requires a specially trained technician to install the conversion components into the pistol, often making the conversion of the pistol to a simulator irreversible.

Therefore, it is readily apparent that there is a recognizable unmet need for an automatic simulation recoiler for converting a firearm into a simulator that is easy to implement and where the weapon simulator provides a realistic firing sensation by providing the proper feel and balance, the proper trigger response, and the proper action of the slide mechanism, without the drawbacks of the present prior art.

SUMMARY

Briefly described, in a preferred embodiment, the present apparatus and method overcomes the above-mentioned disadvantages and meets the recognized need for such a device by providing an automatic simulation recoiler for converting a firearm into a simulator that may be easy to implement or install and may provide a realistic firing sensation.

The present apparatus converts an automatic or semiautomatic firearm with a trigger, a firing pin, a slide, and a magazine into a weapon simulator and includes a sealed cylinder with a piston having a fluid tight seal to an inner wall of the cylinder which thereby creates a compression chamber and a rebound chamber therein. The piston includes a piston rod extending from the piston through the rebound chamber and out of the cylinder. The cylinder has a gas block at the end of the rebound chamber with a pressure relieve valve for allowing fluid to enter and exit the rebound chamber during movement of the piston. The cylinder includes an inlet port in communication with the compression chamber. The piston rod has an end face sized to contact a front surface of the slide for recoiling the slide backward. A power source is in communication with the inlet port of the cylinder for moving the piston, thereby extending the piston rod from the cylinder. A controller is in communication with the power source for controlling the extension of the piston rod from the cylinder. Whereby, when a user presses the trigger, the controller controls the power source to move the piston thereby extending the piston rod from the cylinder and recoiling the slide backward. Whereby, after a user presses the trigger the controller controls the power source to release the piston whereby the slide recoils forward thereby moving the piston rod back into the cylinder.

One feature may be that the power source may be pneumatic power, hydraulic power, or combinations thereof.

Another feature may be that the power source may be a pneumatic power source, whereby the pneumatic power source provides compressed gas to the inlet port that moves the piston thereby extending the piston rod from the cylinder.

One feature of the pneumatic power source may be that it includes a tube interconnecting the pneumatic power source and the inlet port. The tube may extend from the inlet port, around the trigger, and into the magazine.

Another feature of the pneumatic power source may be that it includes an external pneumatic power source or an internal pneumatic power source. The external pneumatic power source may be a compressor. The internal pneumatic power source may be a tank positioned in the magazine.

One feature of the piston rod is that it may have an end face with a notch sized to receive the firing pin.

One feature of the controller may be that it includes at least one sensor that senses the press of the trigger and/or the recoiling of the slide. In select embodiments, the controller may include two sensors, a first sensor that may sense the position of the trigger, and a second sensor that may sense the position of the slide.

Another feature may be the inclusion of a laser or infrared device for indicating the aim of the simulator upon pressing the trigger, or firing of the weapon simulator. The laser or infrared device may be in communication with the controller for determining when the trigger is pressed or the weapon simulator is fired.

Another feature may be that the automatic or semiautomatic weapon that the automatic simulation recoiler is installed on may be a compact or subcompact pistol.

Another feature may be that a weapon simulator may be created using the automatic recoiler disclosed herein.

These and other features of the automatic recoiler device for converting a firearm into a simulator and its method of use thereof will become more apparent to one skilled in the art from the prior Summary, and following Brief Description of the Drawings, Detailed Description, and Claims when read in light of the accompanying Detailed Drawings.

BRIEF DESCRIPTION OF THE DRAWINGS

The present automatic simulation recoiler for converting a firearm into a simulator will be better understood by reading the Detailed Description with reference to the accompanying drawings, which are not necessarily drawn to scale, and in which like reference numerals denote similar structure and refer to like elements throughout, and in which.

It is to be noted that the drawings presented are intended solely for the purpose of illustration and that they are, therefore, neither desired nor intended to limit the disclosure to any or all of the exact details of construction shown, except insofar as they may be deemed essential to the claimed invention.

DETAILED DESCRIPTION

Figure 1:
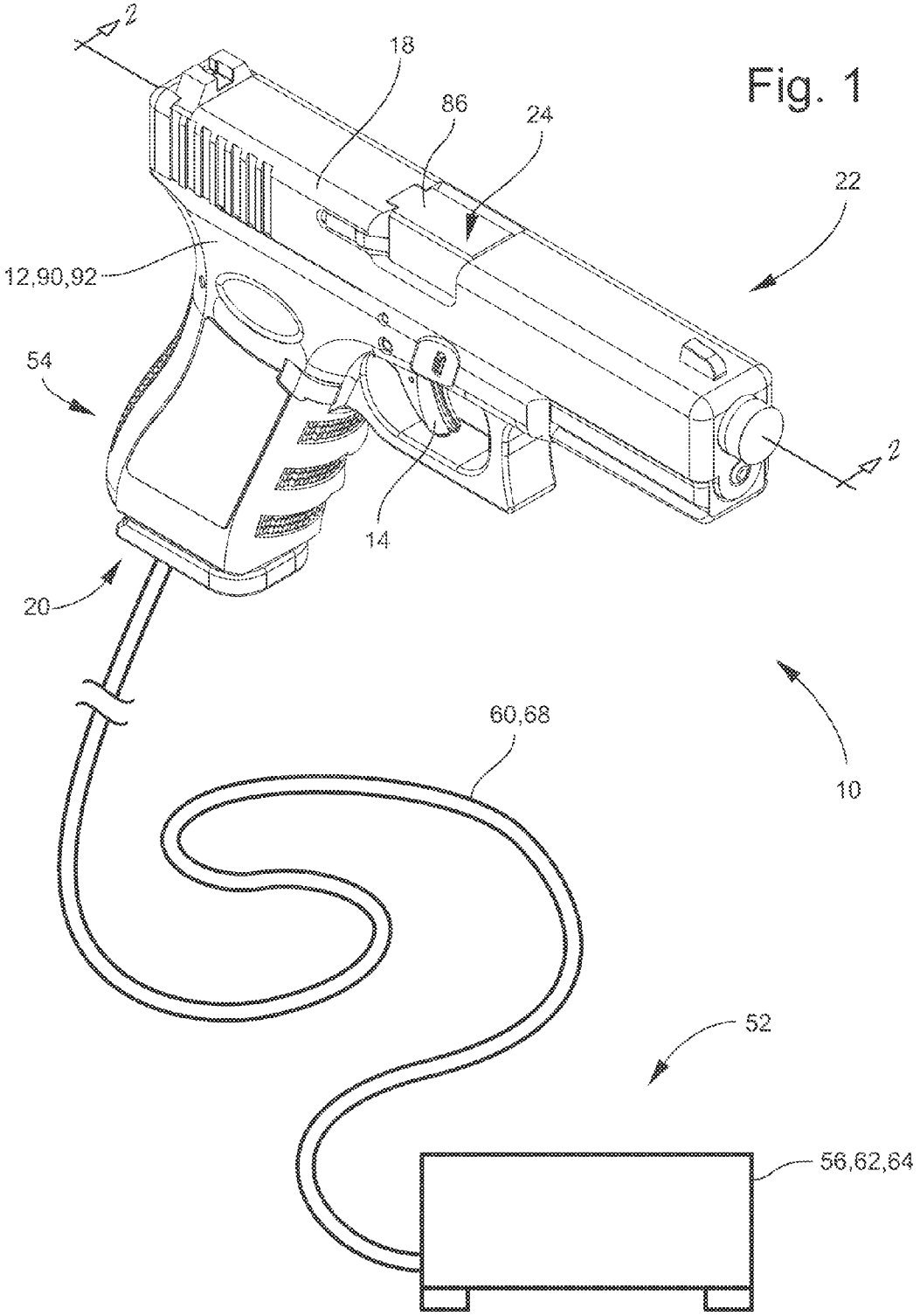
FIG. 1 is a perspective view of an exemplary embodiment of a glock pistol converted into a simulator with the automatic simulation recoiler device.
Figure 2:
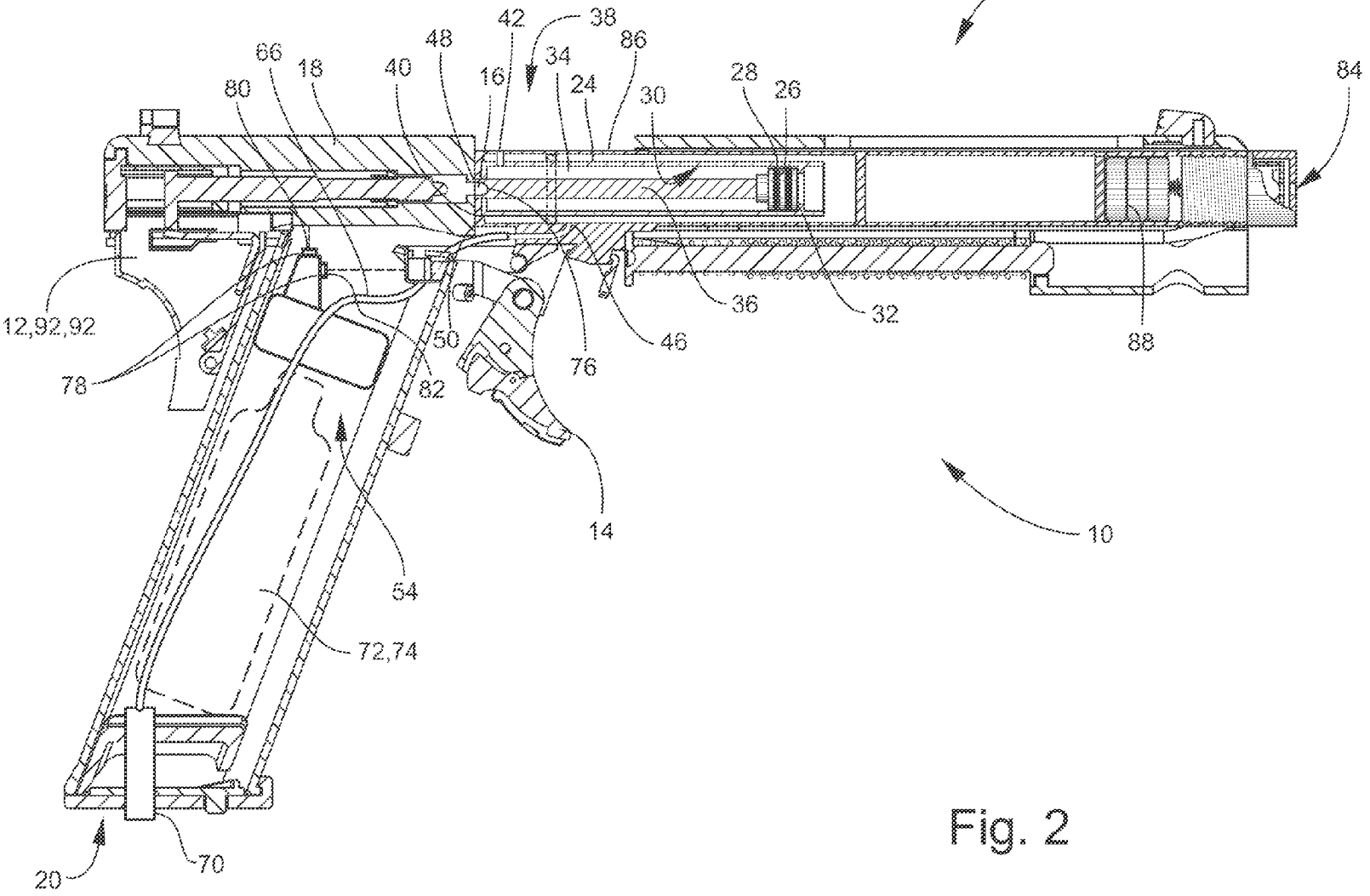
FIG. 2 is a cross-sectional view of the embodiment from FIG. 1.

In describing the exemplary embodiments of the present disclosure, as illustrated in FIGS. 1-3, specific terminology is employed for the sake of clarity. The present disclosure, however, is not intended to be limited to the specific terminology so selected, and it is to be understood that each specific element includes all technical equivalents that operate in a similar manner to accomplish similar functions. Embodiments of the claims may, however, be embodied in many different forms and should not be construed to be limited to the embodiments set forth herein. The examples set forth herein are non-limiting examples, and are merely examples among other possible examples.

Referring now to FIGS. 1-3 by way of example, and not limitation, therein is illustrated example embodiments of automatic simulation recoiler device 10 for converting a firearm 12 into a simulator 22. Device 10 may be adapted for converting any automatic or semiautomatic firearm 12 into simulator 22. Firearm 12 may be a pistol as shown in the Figures, or it may be other automatic or semiautomatic weapons like semi-automatic rifles, etc. Firearm 12 may generally include trigger 14, firing pin 16, slide 18 and magazine 20, as generally known in the art. Automatic simulation recoiler device 10 may be for converting any type of firearm 12 into weapon simulator 22, including, but not limited to, compact or subcompact pistol 90. The compact or subcompact pistol 90 may be any compact or subcompact pistol 90, including, but not limited to glock 92, like a 40 caliber glock, as shown in the Figures.

As shown in FIGS. 1-3, automatic simulation recoiler device 10 may generally comprise sealed cylinder 24 with piston 26. Piston 26 may have fluid tight seal 28 to inner wall 30 of cylinder 24 which may thereby create compression chamber 32 and rebound chamber 34 therein. Piston 26 may include piston rod 36 extending from piston 26 through rebound chamber 34 and out of sealed cylinder 24. Sealed cylinder 24 may have gas block 38 at end 40 of rebound chamber 34. Gas block 38 may include pressure relieve valve 42. Pressure relieve valve 42 may be for allowing fluid 44 to enter and exit rebound chamber 34 during movement of piston 26, while still sealing cylinder 24 from outside contaminants. Sealed cylinder 24 may include inlet port 46 in communication with compression chamber 32. Piston rod 36 may have an end face 48 sized to contact front surface 50 of slide 18 for recoiling slide 18 backward.

Sealed cylinder 24 may be included with automatic simulation recoiler 10. Sealed cylinder 24 may be built into a replacement barrel 86 used to convert automatic or semiautomatic firearm 12 into weapon simulator 22. Sealed cylinder 24 with its pressure relief valve 42 contained in gas block 38 may allow sealed cylinder 24 and piston rod 36 to be sealed. Thus, sealed cylinder 24 eliminates the need for a walled out rod end for relief. Although, FIGS. 1-3 show pressure relief valve 42 oriented where it is coming out the top of weapon simulator 22, this is not limiting and is only for illustrative purposes. It may be desired for safety and/or aesthetic reasons to have pressure relief valve 42 oriented where it is coming out the side of weapon simulator 22. Inlet port 46 may be in communication with compression chamber 32 by any means. In one embodiment, as shown in FIGS. 2-3, inlet port 46 may be positioned on the side of an outer tube around sealed cylinder 24. This outer tube may allow inlet port 46 to be positioned anywhere around sealed cylinder 24 and still provide direct communication to compression chamber 32. In this outer tube embodiment, an opening may be provided at the compression chamber end of sealed cylinder 24 for introducing fluid 60 into compression chamber 32.

Power source 52 may be included with automatic simulation recoiler device 10. Power source 52 may be for moving piston 26 inside sealed cylinder 24. Power source 52 may be any means and/or devices for moving piston 26 inside sealed cylinder 24. Power source 52 may be in communication with inlet port 46 of sealed cylinder 24 Power source 52 may move piston 26 thereby extending piston rod 36 from sealed cylinder 24. Power source 52 may be any type of power source or combination of power sources for moving piston 26 within sealed cylinder 24. As examples, and clearly not limited thereto, power source 52 may be pneumatic power, hydraulic power, the like, etc., or combinations thereof.

Controller 54 may be included with automatic simulation recoiler device 10. Controller 54 may be for controlling the power supplied by power source 52, whereby controller 54 may control the movement of piston 26 within sealed cylinder 24 thereby controlling the extension of piston rod 36 from sealed cylinder 24 and the recoiling backwards of slide 18. Controller 54 may be in communication with power source 52 and may thereby control power source 52. Whereby, when a user presses trigger 14 or fires weapon simulator 22, controller 54 may control power source 52 to move piston 26 thereby extending piston rod 36 from sealed cylinder 24 and recoiling slide 18 backward. In addition, after a user presses trigger 14 or fires weapon simulator 22 and releases trigger 14, controller 54 may control power source 52 to release piston 26 whereby slide 18 may recoil forward thereby moving piston rod 36 back into sealed cylinder 24. As should be understood by those skilled in the art, slide 18 may include a spring or may be biased forward, thereby providing the force to recoil forward and move piston rod 36 back into sealed cylinder 24. Controller 54 may be any device or multiple devices for controlling power source 52. For example, controller 54 may be a computer, microcontroller, microchip, and the like, etc., designed to control power source 52. Controller 54 may be powered by a battery or other like device, which may or may not be rechargeable.

Controller 54 may include any means for determining when to control power source 52. In one embodiment, controller 54 may include at least one sensor 78, or a plurality of sensors 78 that may sense the press of trigger 14 or the firing of weapon simulator 22, and/or the recoiling of weapon simulator 22. In one embodiment, when sensors 78 may sense trigger 14 being pressed, or weapon simulator 22 being fired, controller 54 may signal power source 52 to move piston 26 a set distance to fully recoil slide 18. In this embodiment, once piston 26 is moved the set distance, controller 54 may signal power source 52 to release piston 26 whereby slide 18 may recoil forward. In another embodiment, controller 54 may include two sensors 80 and 82, where first sensor 80 may sense the position of trigger 14, and second sensor 82 may sense the position of slide 18. In this two sensor embodiment, when first sensor 80 may sense trigger 14 being pressed, or simulated weapon 22 being fired, controller 54 may signal power source 52 to move piston 26 thereby extending piston rod 36 from sealed cylinder 24 and recoiling slide 18 backward. Also, when second sensor 82 may sense slide 18 being fully recoiled backwards, controller 54 may signal power source 52 to release piston 26 whereby slide 18 may recoil forward. Slide 18 may recoil forward without any additional force as slide 18 may be biased forward by a spring or like means. Controller 54 may provide an electronically controlled air handler (or fluid handler, or the like, or combinations thereof) that is positioned in the lower receiver, like the pistol grip, for controlling shot duration and gas relief. The use of electronics for controller 54 may reduce the need for intricate machining required to produce mechanical parts of the simulator. This may be cost efficient and may provide for easy conversion and setup of weapon simulator 22.

Referring now to the embodiment shown in FIGS. 1-3, in select embodiments, power source 52 may be pneumatic power source 56. In this pneumatic embodiment, pneumatic power source 56 may provide compressed gas 58 to inlet port 46 for moving piston 26 thereby extending piston rod 36 from sealed cylinder 24. Pneumatic power source 56 may be any device, plurality of devices, or means for supplying pneumatic power to piston 26. Pneumatic power source 56 may include tube 60 interconnecting pneumatic power source 56 and inlet port 46. Tube 60 may be any size, shape or material tube for providing a sealed connection from pneumatic power source 56 to inlet port 46. In addition, tube 60 may be positioned or extend in any direction or path to connect pneumatic power source 56 to inlet port 46. In one embodiment, tube 60 may extend from inlet port 46, around trigger 14, and into magazine 20. This may provide for internal routing of tube 60 within weapon simulator 22.

In one embodiment, pneumatic power source 56 may be an external pneumatic power source 62. See FIGS. 1-2. External pneumatic power source 62 may be any pneumatic power source located external to weapon simulator 22. For example, the external pneumatic power source 62 may be a compressor 64, or portable compressor. In this external pneumatic power source 62 embodiment, tube 60 may extend from magazine 20 outside of weapon simulator 22 to external pneumatic power source 62. Tube 60 may include internal tube 66, external tube 68, and a connection tube 70. Internal tube 66 may extend from inlet port 46, around trigger 14, into magazine 20 and down to the bottom of magazine 20. External tube 68 may extend from magazine 20 to external pneumatic power source 62, like compressor 64. Connection tube 70 may be at the bottom of magazine 20 and may interconnect internal tube 66 and external tube 68.

In another embodiment, pneumatic power source 56 may be an internal pneumatic power source 72. See FIG. 2. One should understand that FIG. 2 shows the use of a combination of external pneumatic power source 62 and internal pneumatic power source 72. However, this is just for illustration and the instant disclosure is clearly not so limited as one or the other of external pneumatic power source 62 and internal pneumatic power source 72 may merely be provided with automatic simulation recoiler 10. Referring now specifically to internal pneumatic power source 72, this may be any internal pneumatic power source positioned within weapon simulator 22. For example, and clearly not limited thereto, internal pneumatic power source 72 may be tank 74 positioned in magazine 20. Tank 74 may be any compressed gas tank, like compressed air, ultra-high compressed gases, like $CO_2$ tanks or cartridges, the like, etc. However, it may be desired to provide pneumatic power source 56 with compressed air common in most garages for easy and cost efficient use. In addition, the use of ultra-high compressed gases may be more dangerous than merely using compressed air.

The use of pneumatic power source 56, whether internal pneumatic power source 72, external pneumatic power source 62, or combinations thereof, may eliminate the need for an air valve system in the barrel and/or piston of the firearm. Alternatively, the pneumatic power source 56 may be provided external to the firearm, within the firearm's magazine, or combinations thereof.

Piston rod 36 may be for pushing slide 18 backwards for recoiling automatic or semiautomatic firearm 12. Piston rod 36 may include an end face 48 for pushing front surface 50 of slide 18. In one embodiment, piston rod end face 48 may have notch 76 sized to receive firing pin 16. Notch 76 may be sized slightly larger than firing pin 16 so that firing pin 16 does not push against or touch piston rod 36, whereas firing pin 16 may not affect the movement of piston rod 36. Notch 76 may allow firing pin 16 to operate freely during the simulated firing of firearm 12. As such, one should clearly understand that automatic simulation recoiler 10 does not use the firing pin to initiate the firing sequence. In addition, notch 76 may aid in positioning piston rod 36 in a central location on front surface 50 of slide 18.

Laser or infrared device 84 may be included with automatic simulation recoiler 10. Laser or infrared device 84 may be for indicating the aim of weapon simulator 22 upon pressing trigger 14 or firing weapon simulator 22. Laser or infrared device 84 may be any device or means for indicating the aim of weapon simulator 22. Laser or infrared device 84 may be in communication with controller 54 for determining when trigger 14 is pressed or weapon simulator 22 is fired. Laser or infrared device 84 may be positioned anywhere on weapon simulator 22 including, but not limited to, in barrel 86. Laser or infrared device 84 may include at least one battery 88 or a plurality of batteries 88 for powering laser or infrared device 84. In addition, laser or infrared device 84 may be powered by controller 54 and/or power source 52. Laser or infrared device 84 may provide accuracy feedback of weapon simulator 22 in real time, by being electronically linked to controller 54. For example, this real time feedback may provide for laser beam shot placement that is accurate to the millisecond or better. In addition, this electronic link from laser or infrared device 84 may reduce the need for any mechanical actuation that may cause the laser to walk or reduce the accuracy of its reading. Laser or infrared device 84 may allow weapon simulator 22 to be used for training with a laser or gaming/simulation with an infrared device.

Figure 3A:
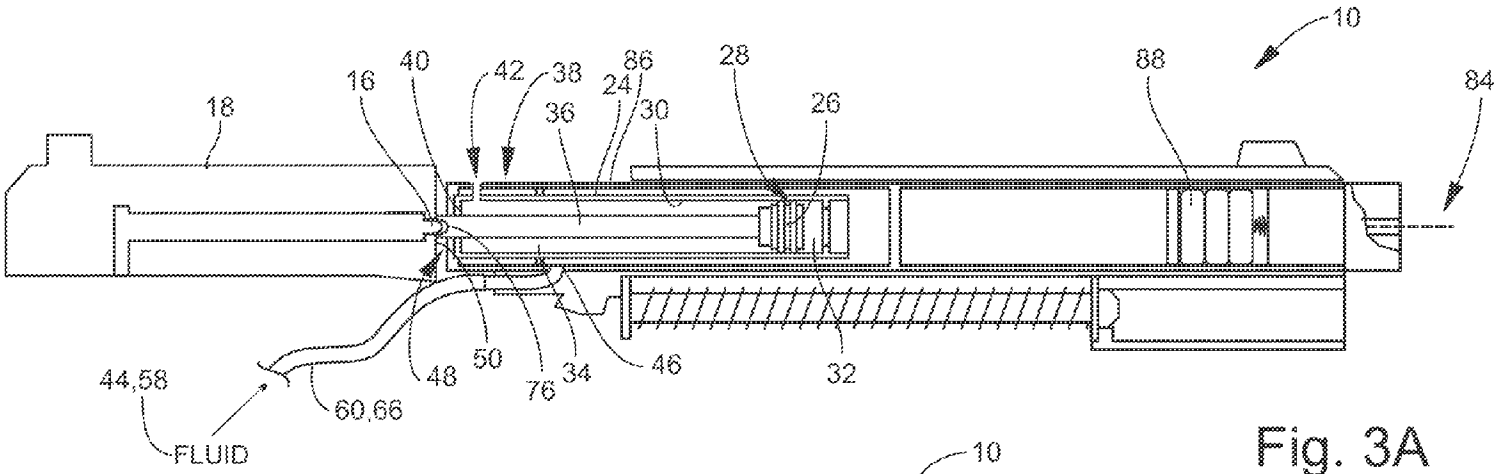
FIG. 3A is a zoomed in cross-sectional view of the embodiment from FIG. 1 with the firing pin extended as the trigger has been compressed.
Figure 3B:
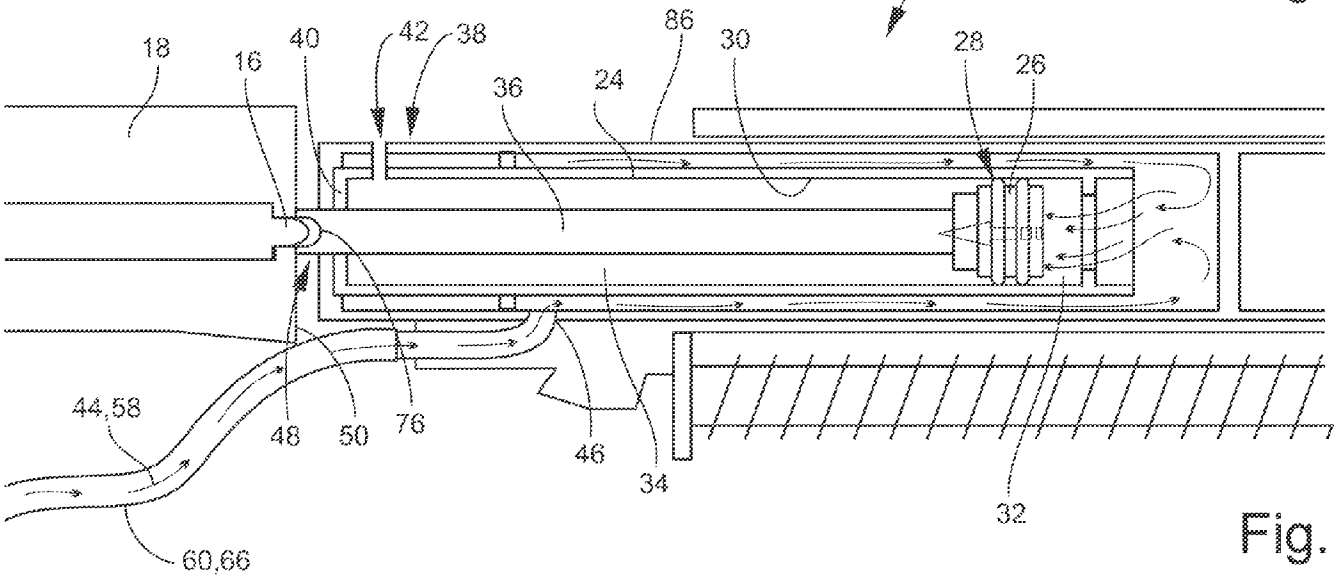
FIG. 3B is another zoomed in cross-sectional view of the embodiment from FIG. 1 showing the compressed air entering the piston as the trigger has been pressed and firing pin extended.
Figure 3C:
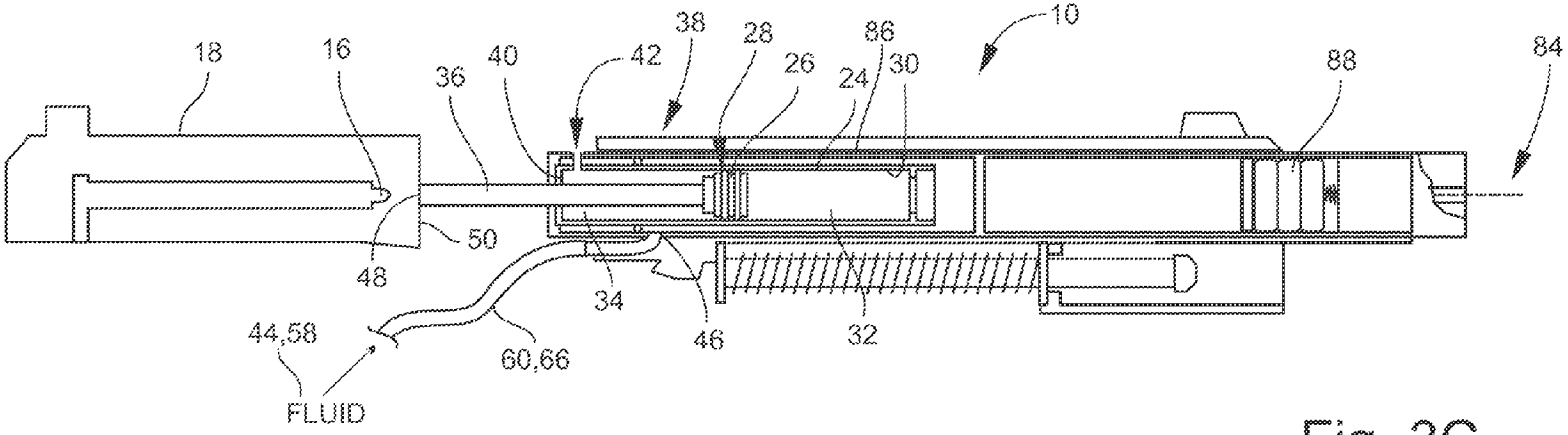
FIG. 3C is a zoomed in cross-sectional view of the embodiment from FIG. 1 with the slide pushed back by the piston.
Figure 3D:
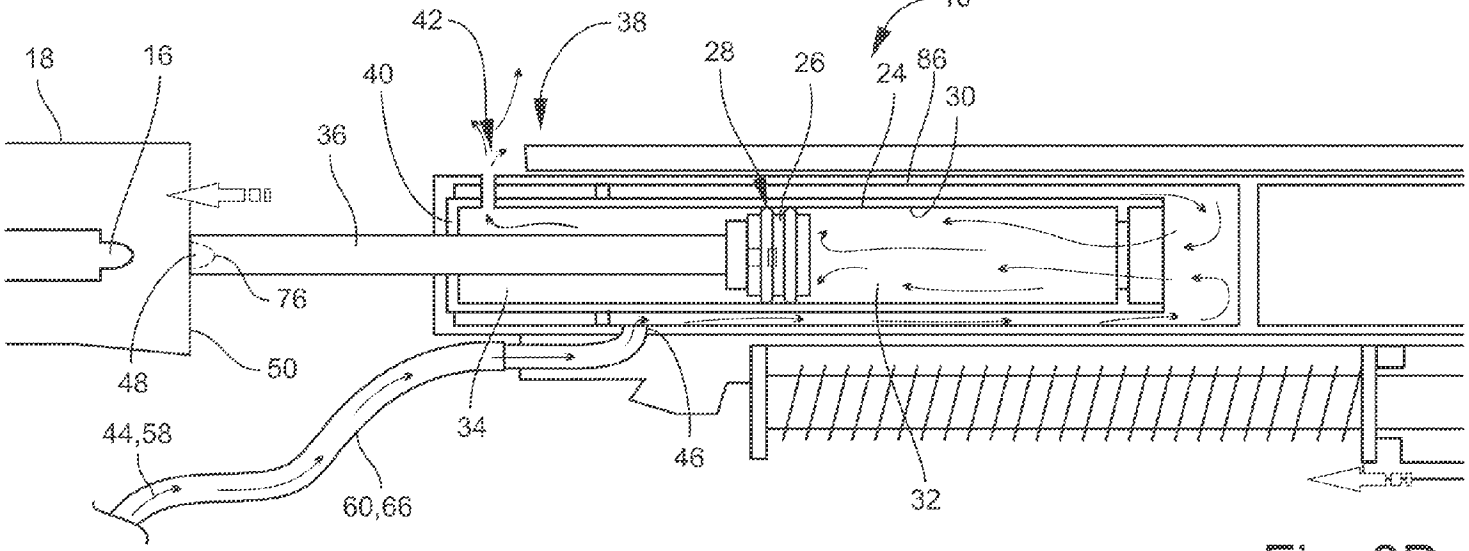
FIG. 3D is another zoomed in cross-sectional view of the embodiment from FIG. 1 showing the compressed air entering the piston and exiting the cylinder as the piston is extended to push back the slide.
Figures 3E, 3F, 3G:
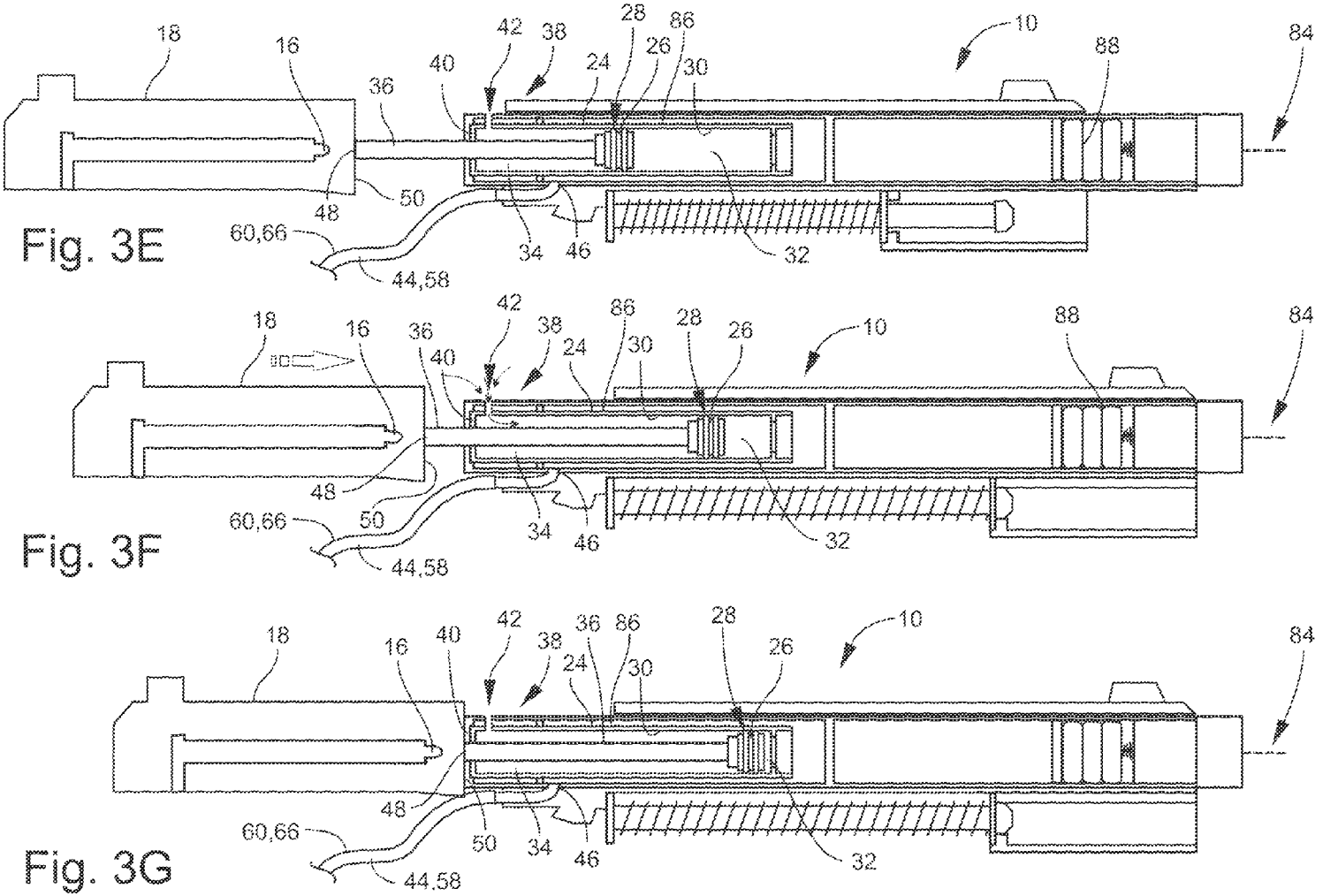
FIG. 3E is a zoomed in cross-sectional view of the embodiment from FIG. 1 with the slide fully recoiled backward.
FIG. 3F is another zoomed in cross-sectional view of the embodiment from FIG. 1 with the slide partially recoiled forward showing the gas entering.
FIG. 3G is another zoomed in cross-sectional view of the embodiment from FIG. 1 with the slide fully recoiled forward.

Referring now to FIGS. 3A-3G, these diagrams represent the operation of piston 26 and the automatic recoiling of weapon simulator 22. FIG. 3A shows the first step of operation where firing pin 16 has been extended once trigger 14 has been compressed. As shown in FIGS. 3A-3B, firing pin 16 is received in notch 76 and does not provide any force onto piston rod 36. As shown in FIG. 3B, once controller 54 senses the compression of trigger 14, this begins the process of forcing fluid 44 into inlet port 46 thereby putting force on piston 26 to move backwards. FIG. 3C shows slide 18 pushed back by piston rod 36. FIG. 3D shows how the compressed air enters sealed cylinder 24 and continues to force piston 26 to move backwards thereby pushing slide 18 backwards. Also, FIG. 3D shows air exiting sealed cylinder 24 through pressure relief valve 42 in gas block 38. FIG. 3E shows that once slide 18 is fully recoiled backwards, air being pumped into inlet port 46 is cutoff by controller 54. FIG. 3F shows that once air is cutoff, slide 18 recoils forward forcing piston rod 36 back into sealed cylinder 24. In addition, FIG. 3F shows that as piston 26 is moving forward, air is allowed to enter sealed cylinder 24 through pressure relief valve 42 in gas block 38. Finally, FIG. 3G shows the slide completely recoiled forward and ready for firing of weapon simulator 22.

To convert automatic or semiautomatic weapon 12 into weapon simulator 22 using automatic simulation recoiler 10, one must first remove the magazine and barrel (or bolt and carrier for rifle). Once removed, the user will replace the barrel (or bolt and carrier for rifle) with barrel 86 (or similar bolt and carrier with sealed cylinder 24) of automatic simulation recoiler 10 and connect inlet port 46 to power source 52. This may require the routing of tube 60 from inlet port 46 into the chamber, around trigger, 14 and into magazine 20. This may also require the simple electrical wiring of laser or infrared device 84 to controller 54.

Automatic simulation recoiler 10 may generally be a pneumatic, and/or hydraulic powered piston for cycling automatic or semi-automatic weapon 12, simulating actual fire cycling characteristics without the use of gun powder. In use, automatic simulation recoiler 10 may function to allow users of automatic or semi-automatic weapons to dry fire weapon systems without using their hands to charge the weapon after each shot. Another feature of automatic simulation recoiler 10 may be its ability to create a more realistic dry fire experience that will allow full auto speed cycling of the weapon (thus simulating live fire without the use of gunpowder). Yet another feature of automatic simulation recoiler 10 may be its ability to conduct weapons training in a safer environment. The instant disclosure replaces the barrel and magazine in pistols and replaces the bolt & carrier and magazine in rifles. Thus, there may be no way a live round can be loaded into weapon simulator 22. Either application will render the weapon safe. There may be no powder blast or loud report from gun powder. As a result, automatic simulation recoiler 10 may allow for a safer, more realistic training environment, and it may allow users to train with their own personal weapons. The inclusion of laser beam or infrared device 84 may show accurately where the user was aiming in real time. Another feature of automatic simulation recoiler 10 may be its ability to reduce the cost of training because no real ammunition or blanks need to be purchased.

The foregoing description and drawings comprise illustrative embodiments. Having thus described exemplary embodiments, it should be noted by those skilled in the art that the within disclosures are exemplary only, and that various other alternatives, adaptations, and modifications may be made within the scope of the present disclosure. Merely listing or numbering the steps of a method in a certain order does not constitute any limitation on the order of the steps of that method. Many modifications and other embodiments will come to mind to one skilled in the art to which this disclosure pertains having the benefit of the teachings presented in the foregoing descriptions and the associated drawings. Although specific terms may be employed herein, they are used in a generic and descriptive sense only and not for purposes of limitation. Accordingly, the present disclosure is not limited to the specific embodiments illustrated herein, but is limited only by the following claims.

What is claimed is:

1. An automatic simulation recoiler for converting an automatic or semiautomatic firearm with a trigger, a firing pin, a slide, and a magazine into a weapon simulator, wherein said automatic recoiler comprises:

a sealed cylinder with a piston having a fluid tight seal to an inner wall of said cylinder which thereby creates a compression chamber and a rebound chamber therein;

said piston includes a piston rod extending from said piston through said rebound chamber and out of said cylinder;

said cylinder has a gas block at the end of said rebound chamber with a pressure relieve valve for allowing fluid to enter and exit said rebound chamber during movement of said piston;

said cylinder includes an inlet port in communication with said compression chamber;

said piston rod has an end face sized to contact a front surface of said slide for recoiling said slide backward, said piston rod end face having a notch sized larger than the firing pin, wherein the firing pin does not push against the piston rod during the simulated firing of the automatic or semiautomatic firearm, and whereby the automatic or semiautomatic firearm does not use the firing pin to initiate the firing sequence;

a power source in communication with said inlet port of said cylinder that moves said piston thereby extending said piston rod from said cylinder;

a controller in communication with said power source that controls the power source thereby controlling the extension of said piston rod from said cylinder, said controller includes:

a first sensor that senses the position of the trigger, whereby when said first sensor senses said trigger being pressed, said controller signals said power source to move said piston thereby extending said piston rod from said cylinder and recoiling said slide backward; and a second sensor that senses the position of the slide, whereby when said second sensor senses said slide being fully recoiled backwards, said controller signals said power source to release said piston whereby a spring in said slide recoiling said slide forward.

2. The automatic recoiler of claim 1 whereby, after a user presses said trigger said controller controls said power source to release said piston whereby said slide recoils forward thereby moving said piston rod back into said cylinder.

3. The automatic recoiler of claim 1 wherein said power source is selected from the group consisting of: pneumatic power; hydraulic power; and combinations thereof.

4. The automatic recoiler of claim 3 wherein said power source is a pneumatic power source, whereby said pneumatic power source provides compressed gas to said inlet port that moves said piston thereby extending said piston rod from said cylinder.

5. The automatic recoiler of claim 4 wherein said pneumatic power source includes a tube interconnecting said pneumatic power source and said inlet port.

6. The automatic recoiler of claim 5 wherein said tube extends from said inlet port, around said trigger, and into said magazine.

7. The automatic recoiler of claim 6 wherein said pneumatic power source is an external pneumatic power source, whereby said tube extends from said magazine to said external pneumatic power source.

8. The automatic recoiler of claim 7 wherein said external pneumatic power source is a compressor.

9. The automatic recoiler of claim 7 wherein said tube includes:

an internal tube extending from said inlet port, around said trigger, into said magazine and down to the bottom of said magazine;

an external tube extending from said magazine to said pneumatic power source; and a connection tube at the bottom of said magazine interconnecting said internal tube and said external tube.

10. The automatic recoiler of claim 4 wherein said pneumatic power source is an internal pneumatic power source, said internal pneumatic power source is a tank positioned in said magazine.

11. The automatic recoiler of claim 1 further including a laser or infrared device for indicating the aim of said simulator upon pressing the trigger, said laser or infrared device is in communication with said controller for determining when the trigger is pressed.

12. The automatic recoiler of claim 11 wherein said laser or infrared device is included in a barrel with at least one battery for powering said laser or infrared device.

13. The automatic recoiler of claim 1 wherein said automatic or semiautomatic weapon is a compact or subcompact pistol.

14. The automatic recoiler of claim 13 wherein said compact or subcompact pistol is a glock.

15. A weapon simulator comprising:

an automatic recoiler for converting an automatic or semiautomatic firearm with a trigger, a firing pin, a slide, and a magazine into the weapon simulator, wherein said automatic recoiler comprises:

a sealed cylinder with a piston having a fluid tight seal to an inner wall of said cylinder which thereby creates a compression chamber and a rebound chamber therein;

said piston includes a piston rod extending from said piston through said rebound chamber and out of said cylinder;

said cylinder has a gas block at the end of said rebound chamber with a pressure relieve valve for allowing air to enter and exit said rebound chamber during movement of said piston;

said cylinder includes an inlet port in communication with said compression chamber;

said piston rod has an end face sized to contact a front surface of said slide for recoiling said slide backward, said piston rod end face having a notch sized larger than the firing pin, wherein the firing pin does not push against the piston rod during the simulated firing of the automatic or semiautomatic firearm, and whereby the automatic or semiautomatic firearm does not use the firing pin to initiate the firing sequence;

a power source in communication with said inlet port of said cylinder that moves said piston thereby extending said piston rod from said cylinder;

a controller in communication with said power source that controls the power source thereby controlling the extension of said piston rod from said cylinder, said controller includes:

a first sensor that senses the position of the trigger, whereby when said first sensor senses said trigger being pressed, said controller signals said power source to move said piston thereby extending said piston rod from said cylinder and recoiling said slide backward; and a second sensor that senses the position of the slide, whereby when said second sensor senses said slide being fully recoiled backwards, said controller signals said power source to release said piston whereby a spring in said slide recoiling said slide forward.

16. The weapon simulator of claim 15 further including a laser or infrared device for indicating the aim of said simulator upon pressing the trigger, said laser or infrared device is in communication with said controller for determining when the trigger is pressed; and said laser or infrared device is included in a barrel with at least one battery for powering said laser or infrared device.

* * * * *